US012767893B2

(12) United States Patent
Lee et al.

(10) Patent No.: US 12,767,893 B2
(45) Date of Patent: Oct. 20, 2026

(54) METHOD FOR PRODUCING RAW MATERIAL OF NAPHTHA CRACKING CENTER

(71) Applicant: LG CHEM, LTD., Seoul (KR)

(72) Inventors: Sung Ho Lee, Daejeon (KR); Sang Beom Lee, Daejeon (KR); Jun Kyo Jeong, Daejeon (KR)

(73) Assignee: LG Chem, Ltd., Seoul (KR)

( * ) Notice: Subject to any disclaimer, the term of this patent is extended or adjusted under 35 U.S.C. 154(b) by 173 days.

(21) Appl. No.: 18/853,086

(22) PCT Filed: Jan. 3, 2024

(86) PCT No.: PCT/KR2024/000091
§ 371 (c)(1),
(2) Date: Sep. 30, 2024

(87) PCT Pub. No.: WO2024/158146
PCT Pub. Date: Aug. 2, 2024

(65) Prior Publication Data

US 2025/0215327 A1 Jul. 3, 2025

(30) Foreign Application Priority Data

Jan. 27, 2023 (KR) ..... 10-2023-0011092

(51) Int. Cl.
*C10G 1/02* (2006.01)
*C10B 53/07* (2006.01)
*C10B 57/06* (2006.01)

(52) U.S. Cl.
CPC ..... *C10G 1/02* (2013.01); *C10B 53/07* (2013.01); *C10B 57/06* (2013.01);
(Continued)

(58) Field of Classification Search
CPC ..... C10B 53/07; C10B 57/06; C10G 1/06; C10G 9/00; C10G 1/10; C10G 1/02;
(Continued)

(56) References Cited

U.S. PATENT DOCUMENTS 10,442,997 B2 * 10/2019 Narayanaswamy ..... C10G 1/02

FOREIGN PATENT DOCUMENTS

JP H06-184567 A 7/1994
JP 3647763 B2 5/2005
(Continued)

OTHER PUBLICATIONS

International Search Report from PCT/KR2024/00091, dated Apr. 9, 2024.

(Continued)

*Primary Examiner* — Vishal V Vasisth
(74) *Attorney, Agent, or Firm* — Bryan Cave Leighton Paisner LLP

(57) ABSTRACT

A method for producing a raw material of a naphtha cracking process, the method including: preparing a pyrolysis composition including a polyolefin or a blend including the polyolefin and a hydrogen donor; and pyrolyzing the pyrolysis composition to obtain pyrolysis products. The method results in an increase in the amount of gasoline included in the pyrolysis product, while significantly decreasing the amount of a heavy hydrocarbon having 23 or more carbon atoms, which is not appropriate as the raw material of a naphtha cracking center. Thus, a yield of the pyrolysis fraction can be further increased while obtaining a high-quality pyrolysis fraction.

8 Claims, 1 Drawing Sheet

(52) U.S. Cl.
CPC . *C10G 2300/1003* (2013.01); *C10G 2400/02* (2013.01); *C10G 2400/04* (2013.01)

(58) Field of Classification Search
CPC ..... C10G 2300/80; C10G 2400/04; C10G 2400/20; C10G 2400/02; C10G 2300/1003
See application file for complete search history.

(56) References Cited

FOREIGN PATENT DOCUMENTS

| | | | |
|---|---|---|---|
| JP | 4236548 | B2 | 3/2009 |
| JP | 2016-216698 | A | 12/2016 |
| JP | 6378368 | B2 | 8/2018 |
| JP | 6565048 | B2 | 8/2019 |
| JP | 2020-513453 | A | 5/2020 |
| KR | 10-2002-0023473 | A | 3/2002 |
| KR | 10-2014-0022023 | A | 2/2014 |
| KR | 10-1515690 | B1 | 5/2015 |
| KR | 10-1568615 | B1 | 11/2015 |
| KR | 10-2315378 | B1 | 10/2021 |

OTHER PUBLICATIONS

Written Opinion of the ISA from PCT/KR2024/00091, dated Apr. 9, 2024.

Vladimir V. Chesnokov et al., "Formic Acid as a Hydrogen Donor for Catalytic Transformations of Tar", Energies 2020, vol. 13, Article No. 4515, pp. 1-12 (Sep. 1, 2020 publication date); doi:10.3390/en13174515.

Seung-Moon Kim et al.,"Effect of Hydrogen-donor on the Cracking of Thermosetting Plastic", Applied Chemistry, vol. 7, No. 1, May 2003, pp. 333-336; English Abstract.

* cited by examiner

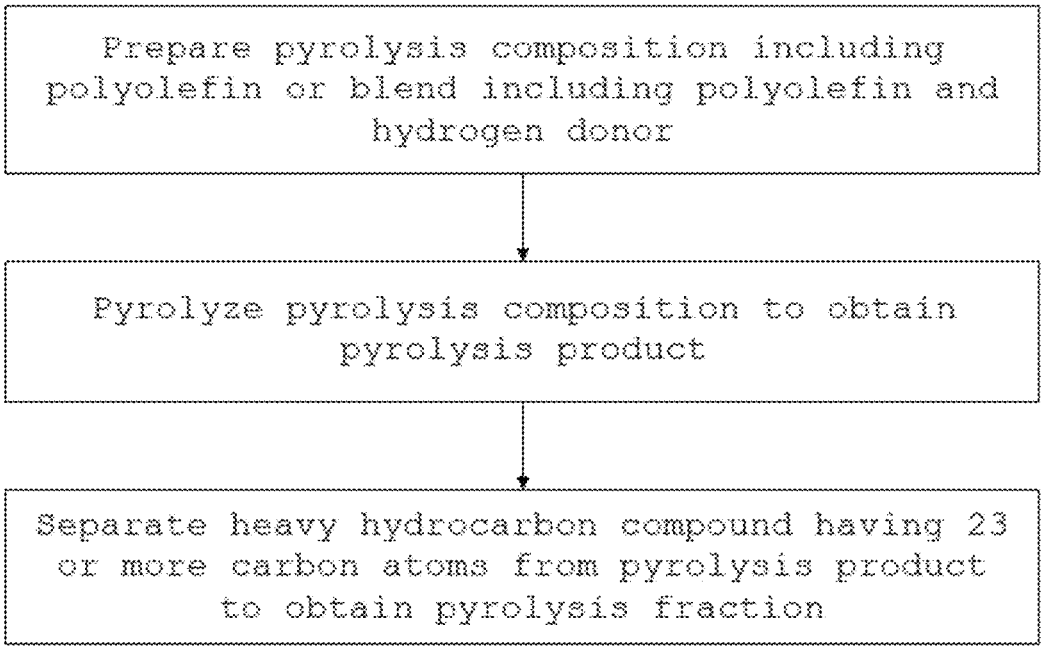
Prepare pyrolysis composition including polyolefin or blend including polyolefin and hydrogen donor
Pyrolyze pyrolysis composition to obtain pyrolysis product
Separate heavy hydrocarbon compound having 23 or more carbon atoms from pyrolysis product to obtain pyrolysis fraction

METHOD FOR PRODUCING RAW MATERIAL OF NAPHTHA CRACKING CENTER

CROSS-REFERENCE TO RELATED APPLICATIONS

The present application is a National Stage Application of International Application No. PCT/KR2024/000091 filed on Jan. 3, 2024, which claims the benefit of priority to Korean Patent Application No. 10-2023-0011092, filed on Jan. 27, 2023, the entire contents of which are incorporated herein by reference as a part of the specification.

TECHNICAL FIELD

The present invention relates to a method for producing a raw material of a naphtha cracking center, and more particularly, to a method of further increasing a yield of a high-quality raw material of a naphtha cracking center by pyrolyzing a polyolefin in the presence of a hydrogen donor.

BACKGROUND ART

Polyethylene (PE) and polypropylene (PP), which are derived from waste plastics, may be pyrolyzed at a high temperature and pressure to obtain a pyrolysis fraction which is an initial raw material of a naphtha cracking center (NCC). The pyrolysis fraction may produce a basic fraction including ethylene and propylene which are basic raw materials for petrochemicals through a naphtha cracking center as a NCC raw material feed, and thus, may be used for manufacturing products in various industrial fields.

However, the pyrolysis fraction obtained by pyrolyzing polyethylene and polypropylene does not have high quality and also its yield does not bring results as expected. Therefore, in order to preferably use the pyrolysis fraction as a raw material of a naphtha cracking center, a method of obtaining a high-quality pyrolysis fraction while further increasing the yield of the pyrolysis fraction is needed.

BRIEF DESCRIPTION

Technical Problem

In order to solve the problems mentioned in the Background Art, an object of the present invention is to provide an effect of further increasing a yield of a pyrolysis fraction while obtaining a high-quality pyrolysis fraction.

Technical Solution

In one general aspect, a method for producing a raw material of a naphtha cracking center includes: preparing a pyrolysis composition including a polyolefin or a blend including the polyolefin and a hydrogen donor; and pyrolyzing the pyrolysis composition to obtain a pyrolysis product.

Advantageous Effects

According to the method for producing a raw material of a naphtha cracking center of the present invention, a pyrolysis composition including a polyolefin or a blend including the polyolefin and a hydrogen donor may be pyrolyzed to obtain a pyrolysis product. Herein, a polymer chain in the pyrolysis composition may be more easily broken by the hydrogen donor included in the pyrolysis composition. Thus, an amount of gasoline included in the pyrolysis product may be effectively increased, and also an amount of a heavy hydrocarbon having 23 or more carbon atoms which is not appropriate as the raw material of a naphtha cracking center may be significantly decreased. Therefore, according to the present invention, a yield of the pyrolysis fraction may be further increased while obtaining a high-quality pyrolysis fraction.

DESCRIPTION OF THE DRAWING

The FIGURE is a flow chart of a method for producing a raw material of a naphtha cracking center according to an exemplary embodiment of the present invention.

DETAILED DESCRIPTION

The terms and words used in the description and claims of the present invention are not to be construed limitedly as having general or dictionary meanings but are to be construed as having meanings and concepts meeting the technical ideas of the present invention, based on a principle that the inventors are able to appropriately define the concepts of terms in order to describe their own inventions in the best mode.

In the present invention, the term "C#" in which "#" is a positive integer, represents a mixture including all hydrocarbon compounds having # carbon atoms. Therefore, the term "C8" represents a mixture including a hydrocarbon compound having 8 carbon atoms. In addition, the term "C#−" represents all hydrocarbon molecules having # or fewer carbon atoms. Therefore, the term "C8−" represents a mixture of hydrocarbons having 8 or fewer carbon atoms. In addition, the term "C#+" represents all hydrocarbon molecules having # or more carbon atoms. Therefore, the term "C10+" represents a mixture of hydrocarbons having 10 or more carbon atoms.

Hereinafter, the present invention will be described in more detail for better understanding of the present invention, with reference to the FIGURE.

According to an exemplary embodiment of the present invention, a method for producing a raw material of a naphtha cracking center includes: preparing a pyrolysis composition including a polyolefin or a blend including the polyolefin and a hydrogen donor; and pyrolyzing the pyrolysis composition to obtain a pyrolysis product is provided.

First, the method for producing a raw material of a naphtha cracking center according to an exemplary embodiment of the present invention may include preparing a pyrolysis composition including a polyolefin or a blend including the polyolefin and a hydrogen donor. The blend is a blend including a polyolefin and may refer to all compositions including a polyolefin.

The polyolefin may be derived from waste plastics, and the waste plastics may include one or more resins such a polyolefin, polystyrene, polyvinyl chloride, polyethylene terephthalate, and ABS. The waste plastic is a polymer waste, and since the treatment method may be problematic due to an increase in amounts produced, a method of recycling the waste plastics more effectively is needed.

The polyolefin or the blend including the polyolefin of the present invention may be obtained by a pretreatment process of waste plastics. The pretreatment process of waste plastics may refer to sorting and crushing waste plastics appropriate for the present invention among the waste plastics, in order to increase a yield of a raw material of a naphtha cracking center in pyrolysis of the pyrolysis composition described later. Herein, a composition of the waste plastics appropriate for the present invention may include 60 to 100 wt % of the polyolefin. Since the waste plastics to be discarded may be recycled by the pretreatment process of the waste plastics as described above, environmental pollution caused by discarding the waste plastics may be reduced. According to an exemplary embodiment of the present invention, the polyolefin or the blend including the polyolefin may be derived from a crushed product of the waste plastics.

According to the present invention, the polyolefin may include one or more of polyethylene (PE) and polypropylene (PP). Herein, the polyethylene may include high-density polyethylene (HDPE), low-density polyethylene (LDPE), and linear low-density polyethylene (LLDPE), depending on its density. Herein, when the low-density polyethylene is pyrolyzed, the polyethylene may be more easily decomposed as compared with the case of pyrolyzing the high-density polyethylene.

According to an exemplary embodiment, the polyolefin may include polyethylene and polypropylene, and a ratio between an amount of polyethylene and an amount of polypropylene in the pyrolysis composition may be 40:60 to 60:40.

A hydrogen donor of the present invention may donate a pyrolysis composition, specifically, hydrogen radicals during pyrolysis of a polyolefin. The hydrogen radical may serve to help the polyolefin which is a polymer in the pyrolysis composition pyrolyze better, in pyrolyzing the pyrolysis composition.

According to an exemplary embodiment of the present invention, the hydrogen donor may include one or more of formic acid, benzoic acid, ethylene glycol, and phenol, preferably formic acid. When the formic acid is used as a hydrogen donor, the formic acid may further promote pyrolysis of a polyolefin which is a polymer in the pyrolysis composition to increase the yield of the raw material of a naphtha cracking center to be obtained in the present invention.

An amount of the hydrogen donor in the pyrolysis composition may be 5 wt % or more, 6 wt % or more, or 7 wt % or more and 20 wt % or less, 15 wt % or less, or 12 wt % or less with respect to a total of 100 wt % of the pyrolysis composition.

Specifically, the amount of the hydrogen donor in the pyrolysis composition may be 5 to 20 wt %, more specifically 7 to 20 wt %, 7 to 15 wt %, or 5 to 15 wt %. When the amount of the hydrogen donor in the pyrolysis composition is less than 5 wt %, the amount of the hydrogen donor included in the pyrolysis composition is too low, and thus, it may be difficult to obtain an effect to be achieved by the hydrogen donor during the pyrolysis of the pyrolysis composition, that is, it may be difficult to pyrolyze a polyolefin well by a donated hydrogen radical. When the amount of the hydrogen donor in the pyrolysis composition is more than 20 wt %, the hydrogen donor remains in the pyrolysis product after the pyrolysis of the pyrolysis composition or a reaction between the hydrogen donors occurs during the pyrolysis of the pyrolysis composition, thereby decreasing the pyrolysis efficiency of the pyrolysis composition. Furthermore, an amount of gas produced during the pyrolysis of the pyrolysis composition may be increased to decrease the yield of the raw material of a naphtha cracking center.

Meanwhile, according to another exemplary embodiment of the present invention, the pyrolysis composition may further include one or more of a metal catalyst and an acid catalyst. The metal catalyst may include one or more of zeolite, aluminum phosphate and alumina. It is possible to perform efficient pyrolysis of a polyolefin in the pyrolysis composition by the metal catalyst and/or the acid catalyst.

The method for producing a raw material of a naphtha cracking center according to an exemplary embodiment of the present invention may include pyrolyzing the pyrolysis composition including a polyolefin or a blend including the polyolefin and a hydrogen donor to obtain a pyrolysis product.

The pyrolysis product may include gasoline (C5 to C12), diesel (C13 to C22), and a heavy hydrocarbon compound having 23 or more carbon atoms which are classified depending on the number of carbon atoms, and, in addition to them, may further include a gas. The gas may be a gas after the pyrolysis composition completes the pyrolysis in the pyrolysis reactor, and the gas may include $CO_2$, methane, ethane, propane, hydrogen, and aldehyde.

Specifically, the gasoline may be a mixture including a hydrocarbon compound having 5 to 12 carbon atoms as a main component, and the diesel may be a mixture including a hydrocarbon compound having 13 to 22 carbon atoms as a main component. In addition, the heavy hydrocarbon compound having 23 or more carbon atoms may be a mixture including the hydrocarbon compound having 23 or more carbon atoms as a main component. Herein, the main component refers to a component present in the mixture in an amount of 95 wt % or more or 100 wt %, and for example, in the case of gasoline, may refer to a hydrocarbon compound having 5 to 12 carbon atoms included at 95 wt % or more or 100 wt % in the gasoline.

More specifically, the pyrolysis product may be obtained by the reaction as follows. When the pyrolysis composition including a polyolefin and a hydrogen donor is pyrolyzed, heat is applied to decompose the polyolefin which is a polymer in the pyrolysis composition into low molecular weight molecules.

During the common pyrolysis of the polyolefin, a bond between carbon and hydrogen of the polymer (C-H bond) may be broken before a bond between carbons (a single bond or a multiple bond), thereby producing a hydrogen radical. The hydrogen radical produced as such may act so that the pyrolysis of the bond between other carbons may be easily performed (that is, a bond between carbons may be more easily broken). The action of the hydrogen radical and the pyrolysis of the polyolefin as such may be performed in succession.

Since the present invention includes the hydrogen donor which serves to donate the hydrogen radical during the pyrolysis in the pyrolysis composition with the polyolefin, a bond between carbon and hydrogen is broken to introduce a higher amount of hydrogen radicals in the pyrolysis of the polyolefin in addition to the produced hydrogen radicals, thereby promoting smooth pyrolysis of the polyolefin. Therefore, the efficiency of the pyrolysis may be improved overall, the amount of gasoline in the pyrolysis product may reach a level to be desired in the present invention, and thus, a high-quality raw material of a naphtha cracking center may be obtained.

Meanwhile, the pyrolysis may be performed in a pyrolysis reactor, and the pyrolysis reactor may include one or more of a rotary kiln, a continuous stirred tank reactor (CSTR), a tubular reactor, and a batch reactor.

In addition, the pyrolysis may be performed at a temperature of 380 to 520° C. More specifically, it may be performed at a temperature of 400 to 500° C. or 430 to 470° C. When the pyrolysis is performed in a temperature condition in the range, the hydrogen donor included in the pyrolysis composition may release hydrogen radicals to break a polymer chain in the pyrolysis composition more easily. Thus, the amount of a heavy hydrocarbon compound having 23 or more carbon atoms in the pyrolysis product is decreased and the total amount of gasoline and diesel is relatively increased, thereby further obtaining the pyrolysis fraction described later.

According to an exemplary embodiment of the present invention, the amount of the gasoline, the diesel, and the heavy hydrocarbon compound having 23 or more carbon atoms in the pyrolysis product obtained by the pyrolysis may be 50 wt % or more, 70 wt % or more, or 80 wt % or more and 90 wt % or less, 88 wt % or less, or 85 wt % or less with respect to a total of 100 wt % of the pyrolysis composition.

Meanwhile, according to an exemplary embodiment of the present invention, a gas chromatography (GC) area of the gasoline included in the pyrolysis product may be 65 to 90% with respect to a total of 100% of gas chromatography areas of the gasoline, the diesel, and the heavy hydrocarbon compound having 23 or more carbon atoms included in the pyrolysis product. More specifically, it may be 67 to 88% or 70 to 85%. When the GC area of the gasoline included in the pyrolysis product is within the range, the raw material of a naphtha cracking center obtained in the present invention may be used in the naphtha cracking center as a high-quality raw material. In general, light naphtha added to the naphtha cracking center as a raw material has a boiling point of 100° C. or lower, and the boiling point of the gasoline included in the pyrolysis product may also be similar thereto. Therefore, according to an exemplary embodiment of the present invention, a pyrolysis fraction including a higher amount of gasoline may be a high-quality raw material of a naphtha cracking center. Thus, light naphtha which is the raw material of a naphtha cracking center is replaced with the pyrolysis fraction including gasoline derived from waste plastics, thereby satisfying carbon reduction in the naphtha cracking center, which may be thus preferred from an environmental perspective.

The GC area described above may be analyzed by gas chromatography (GC) analysis. The GC analysis refers to a sorting device for sorting the content of a subject to be measured or a method therefor. The GC analysis may include a column used to separate various compounds and a detector which measures atomic mass of a material introduced from the column. When a sample to be analyzed is measured by the GC analysis, a GC graph depicting the amount of each component finally included in the sample may be obtained. Therefore, relative comparison of the amount by each component may be measured by the area ratio of the GC graph.

Specifically, the gas chromatography area of gasoline included in the pyrolysis product is a value represented as a ratio of a GC area of gasoline included in the pyrolysis product to GC areas of gasoline, diesel, and a heavy hydrocarbon compound having 23 or more carbon atoms included in the pyrolysis product, in the GC graph obtained by the GC analysis method.

The method for producing a raw material of a naphtha cracking center according to an exemplary embodiment of the present invention may further include separating a heavy hydrocarbon compound having 23 or more carbon atoms from the pyrolysis product to obtain a pyrolysis fraction. When the pyrolysis product is added as the raw material of a naphtha cracking center without separating the heavy hydrocarbon compound having 23 or more carbon atoms, a caulking phenomenon occurs and formation of tar may be promoted in the naphtha cracking center. Furthermore, the yield of a basic fraction to be obtained in the naphtha cracking center may be decreased. The caulking phenomenon may refer to a phenomenon in which as carbon is deposited in a cracking furnace tube in the naphtha cracking center, a conveyance path in the cracking furnace tube in the naphtha cracking center is narrowed. Due to the occurrence of the caulking phenomenon, operation of the naphtha cracking center may be stopped, and thus, it may not be preferred from an economic perspective. Therefore, separate separation and removal of the heavy hydrocarbon compound having 23 or more carbon atoms included in the pyrolysis product is needed. The pyrolysis fraction obtained by separating and removing the heavy hydrocarbon compound having 23 or more carbon atoms as such may include gasoline (C5 to C12) and diesel (C13 to C22).

The separation and removal of the heavy hydrocarbon compound having 23 or more carbon atoms included in the pyrolysis product may be performed by supplying the pyrolysis product to one or two or more distillation towers. First, when the process is performed by one distillation tower, gas may be separated from the upper portion, gasoline and diesel are separated from the side portion, and the heavy hydrocarbon compound having 23 or more carbon atoms may be separated from the lower portion, of the one distillation tower, respectively.

Meanwhile, when the process is performed in two or more distillation towers, it may be performed through one or more distillation towers which separate the gasoline and the diesel from the lower portion and one or more distillation towers which separate the heavy hydrocarbon compound having 23 or more carbon atoms from the lower portion. Gas may be separated from the upper portion of the two or more distillation towers. Herein, the gas separated from the upper portion of the two or more distillation towers may be added as a fuel of a boiler provided in the naphtha cracking center.

According to the present invention, the pyrolysis fraction may be a raw material feed of a naphtha cracking center. Specifically, the pyrolysis fraction may be a raw material feed of NCC as a fuel of a naphtha cracking center (NCC) in a different technical field. The NCC may be performed by including a cracking process, a quenching process, a compression process, and a refining process. The pyrolysis fraction produces a basic fraction including ethylene and propylene which are basic raw materials of petrochemical through NCC, and the basic fraction may be used to obtain various types of chemical materials such as synthetic resin, synthetic fiber, synthetic rubber, and other chemical products.

Meanwhile, before the pyrolysis fraction is introduced to the raw material feed of NCC, the pyrolysis fraction may be supplied to a distillation process. More specifically, the distillation process may be a process of distilling the pyrolysis fraction to separately obtain naphtha and removing impurities from the naphtha or adding hydrogen to the naphtha to perform refining. Thus, the naphtha obtained from the pyrolysis fraction may be further refined and supplied to the raw material feed of NCC.

EXAMPLES

Hereinafter, the present invention will be described in more detail by the examples. However, the following examples are provided for illustrating the present invention, and it is apparent to a person skilled in the art that various modifications and alterations may be made without departing from the scope and spirit of the present invention, and the scope of the present invention is not limited thereto.

Experimental Examples

GC areas of gasoline, diesel, and a heavy hydrocarbon compound having 23 or more carbon atoms included in pyrolysis products prepared in the following examples and comparative examples were measured by the following method. Specifically, the GC area was measured by gas chromatography analysis, in which an autosampler and Agilent 7890B Gas Chromatograph System were used as an analysis device and helium was used as a carrier gas.

A pyrolysis product obtained by pyrolyzing a pyrolysis composition including a pyrolysis fuel oil including a first aromatic compound, a polyolefin, and a hydrogen donor was supplied to a centrifuge to separate gas and a solid and take out the remainder to prepare a sample. The sample was supplied to an autosampler (set to 0.2 μml (amount of injected sample) and at 400° C. (temperature at which the sample was injected)). The sample was injected into an oven included in the Agilent 7890B through the autosampler. The sample injected into the oven was added to a column (Frontier UA-5 (MS/HT), 30 m×250 μm×0.2 μm) provided in the oven. Components obtained from the column were supplied to a detector. At this time, a flame ionization detector (FID) was used as the detector and the temperature was set at 400° C. A gas chromatography graph was obtained from the detector.

In the gas chromatography graph, a GC area corresponding to gasoline, a GC area corresponding to diesel, and a GC area corresponding to a heavy hydrocarbon compound having 23 or more carbon atoms were calculated, and the sum of these (total GC area) was taken as 100%. At this time, a ratio of the GC area of each component with respect to 100% of the total GC area (that is, GC area fraction) was calculated. At this time, each component may refer to gasoline, diesel, and a heavy hydrocarbon compound having 23 or more carbon atoms.

Meanwhile, dodecane (C12) and docosane (C22) were used as a standard reagent.

EXAMPLES

Example 1

A raw material of a naphtha cracking center was obtained according to the flow chart shown in the FIGURE.

Specifically, a pyrolysis composition including 9 g of polyethylene, 6 g of polypropylene, and 1.5 g of formic acid as a hydrogen donor was prepared. The amount of the hydrogen donor in the pyrolysis composition was 9.2 wt %.

Next, the pyrolysis composition was supplied to a tubular reactor and pyrolyzed to obtain a pyrolysis product. At this time, the pyrolysis performed in the pyrolysis reactor was performed at a temperature of 450° C. for 60 minutes. The pyrolysis product included gasoline, diesel, the heavy hydrocarbon compound having 23 or more carbon atoms, and gas. The amount of gasoline, diesel, and the heavy hydrocarbon compound having 23 or more carbon atoms in the pyrolysis product was 80%.

Meanwhile, the GC area fraction of gasoline in the pyrolysis product was 72.62%. The GC area fraction of diesel was 25.05% and the GC area fraction of the heavy hydrocarbon compound having 23 or more carbon atoms was 2.33%. At this time, the GC area fraction was measured by gas chromatography (using the Agilent 7890B device) analysis.

Subsequently, the heavy hydrocarbon compound having 23 or more carbon atoms was separated and removed from the pyrolysis product to obtain a pyrolysis fraction including gasoline and diesel. The pyrolysis fraction was added to a raw material feed of a naphtha cracking center as a raw material of a naphtha cracking center.

Example 2

A raw material of a naphtha cracking center was produced in the same manner as in Example 1, except that phenol rather than formic acid was used as the hydrogen donor in the pyrolysis composition.

The GC area fraction of gasoline in the pyrolysis product obtained by pyrolyzing the pyrolysis composition was 67.29%. The GC area fraction of diesel in the pyrolysis product was 29.04% and the GC area fraction of the heavy hydrocarbon compound having 23 or more carbon atoms was 3.67%.

It was confirmed in Example 2 that the GC area fraction of gasoline was decreased and the GC area fraction of the heavy hydrocarbon compound having 23 or more carbon atoms was increased in the pyrolysis product, as compared with Example 1, by using phenol rather than formic acid as the hydrogen donor in the pyrolysis composition.

Example 3

In Example 3, a raw material of a naphtha cracking center was produced in the same manner as in Example 1, except that the amount of the hydrogen donor (formic acid) in the pyrolysis composition was 4 wt %.

The GC area of gasoline in the pyrolysis product obtained by pyrolyzing the pyrolysis composition was 65.7%. The GC area fraction of diesel in the pyrolysis product was 30.8% and the GC area fraction of the heavy hydrocarbon compound having 23 or more carbon atoms was 3.5%.

It was confirmed in Example 3 that the GC-MS area of gasoline which may be used as a high-quality raw material of a naphtha cracking center was decreased as compared with Examples 1 and 2, by decreasing the amount of the hydrogen donor in the pyrolysis composition as compared with Example 1.

Example 4

In Example 4, a raw material of a naphtha cracking center was produced in the same manner as in Example 1, except that the amount of the hydrogen donor (formic acid) in the pyrolysis composition was 20 wt %.

The GC area fraction of gasoline in the pyrolysis product obtained by pyrolyzing the pyrolysis composition was 77.4%. The GC area fraction of diesel in the pyrolysis product was 19.9% and the GC area fraction of the heavy hydrocarbon compound having 23 or more carbon atoms was 2.7%.

It was confirmed in Example 4 that the GC area fraction of the heavy hydrocarbon compound having 23 or more carbon atoms in the pyrolysis product was increased as compared with Example 1, by increasing the amount of the hydrogen donor in the pyrolysis composition as compared with Example 1.

COMPARATIVE EXAMPLES

Comparative Example 1

In Comparative Example 1, a raw material of a naphtha cracking center was produced in the same manner as in Example 1, except that a pyrolysis composition including no hydrogen donor was pyrolyzed.

The GC area fraction of gasoline in the pyrolysis product obtained by pyrolyzing the pyrolysis composition was 63.79%. The GC area fraction of diesel in the pyrolysis product was 31.92% and the GC area fraction of the heavy hydrocarbon compound having 23 or more carbon atoms was 4.29%.

In Comparative Example 1, the raw material of a naphtha cracking center was produced without including the hydrogen donor in the pyrolysis composition, and it was confirmed that the GC area fraction of gasoline in the pyrolysis product was the lowest and the GC area fraction of the heavy hydrocarbon compound having 23 or more carbon atoms was the highest among the examples and the comparative example. It was confirmed therefrom that when the hydrogen donor was not included in the pyrolysis composition, the pyrolysis of polyethylene and polypropylene in the pyrolysis composition was not easily performed.

The invention claimed is:

1. A method for producing a raw material of a naphtha cracking center, comprising:

preparing a pyrolysis composition including a polyolefin and a hydrogen donor; and pyrolyzing the pyrolysis composition to obtain a pyrolysis product, wherein the hydrogen donor includes one or more of formic acid, benzoic acid, ethylene glycol, and phenol, wherein an amount of the hydrogen donor in the pyrolysis composition is 5 to 20 wt %.

2. The method of claim 1, further comprising separating a heavy hydrocarbon compound having 23 or more carbon atoms from the pyrolysis product to obtain a pyrolysis fraction.

3. The method of claim 1, wherein the polyolefin includes one or more of polyethylene and polypropylene.

4. The method of claim 1, wherein the pyrolysis is performed at a temperature of 380 to 520° C.

5. The method of claim 1, wherein the pyrolysis product includes gasoline, diesel, and a heavy hydrocarbon compound having 23 or more carbon atoms, and an amount of the gasoline, the diesel, and the heavy hydrocarbon compound having 23 or more carbon atoms in the pyrolysis product is 50 to 90 wt %.

6. The method of claim 5, wherein the gasoline is a mixture including 95 wt % or more of a hydrocarbon compound having 5 to 12 carbon atoms.

7. The method of claim 5, wherein a gas chromatography area of the gasoline included in the pyrolysis product is 65 to 90% with respect to a total of 100% of gas chromatography areas of the gasoline, the diesel, and the heavy hydrocarbon compound having 23 or more carbon atoms included in the pyrolysis product, and the gas chromatography area is measured from a gas chromatography graph obtained by gas chromatography analysis.

8. The method of claim 2, wherein the pyrolysis fraction is a raw material feed of the naphtha cracking center.

* * * * *